US010088193B2

(12) United States Patent
Inui

(10) Patent No.: US 10,088,193 B2
(45) Date of Patent: Oct. 2, 2018

(54) AIR-CONDITIONING APPARATUS INCLUDING A CONTROLLER THAT CONTROLS OPENING DEGREES OF EXPANSION VALVES BASED ON DETECTION RESULTS OF HUMAN DETECTION DEVICES

(75) Inventor: Kunihiro Inui, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1212 days.

(21) Appl. No.: 13/477,499

(22) Filed: May 22, 2012

(65) Prior Publication Data

US 2013/0008198 A1 Jan. 10, 2013

(30) Foreign Application Priority Data

Jul. 6, 2011 (JP) ..... 2011-150035

(51) Int. Cl.
*F25B 5/00* (2006.01)
*F25B 41/04* (2006.01)
(Continued)

(52) U.S. Cl.
CPC ..... *F24F 11/83* (2018.01); *F24F 11/30* (2018.01); *F24F 11/84* (2018.01);
(Continued)

(58) Field of Classification Search
CPC ..... F24F 11/0034; F24F 2011/0035; F24F 11/0008; F24F 2011/0082; F24F 2120/00;
(Continued)

(56) References Cited

U.S. PATENT DOCUMENTS 4,307,576 A * 12/1981 Takano ..... F25B 5/02 165/207
4,644,756 A * 2/1987 Sugimoto ..... F24F 3/065 62/160
(Continued)

FOREIGN PATENT DOCUMENTS

CA 2668812 A1 * 12/2010 ..... F24F 3/00
CN 1158964 A 9/1997
(Continued)

OTHER PUBLICATIONS

Japanese Office Action dated Jun. 17, 2014 issued in corresponding Japanese Patent Appln. No. 2011-150035, with English translation (8 pages).
(Continued)

*Primary Examiner* — Ned Landrum
*Assistant Examiner* — Daniel C Comings
(74) *Attorney, Agent, or Firm* — Buchanan Ingersoll & Rooney PC

(57) ABSTRACT

Human detection devices 8 that detect the number of people in conditioned spaces supplied with conditioned air from the use side heat exchangers 12 and control means 9 and 50 that controls an amount of refrigerant supplied to the use side heat exchangers 12 by controlling opening degrees of the expansion devices 5 on the basis of detection results of the human detection devices 8.

6 Claims, 8 Drawing Sheets

(51) Int. Cl.

| | |
|---|---|
| ***F24D 19/10*** | (2006.01) |
| ***F24F 11/00*** | (2018.01) |
| ***G05D 23/275*** | (2006.01) |
| ***F24F 11/83*** | (2018.01) |
| ***F24F 11/30*** | (2018.01) |
| *F24F 120/00* | (2018.01) |
| *F24F 120/12* | (2018.01) |
| *F25B 13/00* | (2006.01) |
| *F24F 120/10* | (2018.01) |
| *F24F 11/84* | (2018.01) |

(52) U.S. Cl.
CPC ..... *F24F 2120/00* (2018.01); *F24F 2120/10* (2018.01); *F24F 2120/12* (2018.01); *F25B 13/00* (2013.01); *F25B 2313/0233* (2013.01); *F25B 2313/02741* (2013.01); *F25B 2600/2513* (2013.01)

(58) Field of Classification Search
CPC ..... F24F 2120/10; F24F 2120/12; F25B 2313/0233; F25B 2600/25; F25B 2600/2503; F25B 2600/2507; F25B 2600/2513
USPC ..... 62/199, 222; 236/1 B; 165/237
See application file for complete search history.

(56) References Cited

U.S. PATENT DOCUMENTS

2009/0282854 A1* 11/2009 Matsuoka ..... F24F 3/001 62/335
2010/0174414 A1 7/2010 Takagi et al.
2011/0130881 A1* 6/2011 Nanami ..... F24F 3/044 700/277

FOREIGN PATENT DOCUMENTS

| | | | |
|---|---|---|---|
| CN | 101029764 | A | 9/2007 |
| CN | 101769574 | A | 7/2010 |
| EP | 1 571 405 | A2 | 9/2005 |
| JP | 5-306848 | A | 11/1993 |
| JP | 08-303848 | A | 11/1996 |
| JP | H10267352 | A | 10/1998 |
| JP | 11-132530 | A | 5/1999 |
| JP | 2005-153683 | A | 6/2005 |
| JP | 2008-045779 | A | 2/2008 |
| JP | 2010-243090 | A | 10/2010 |
| JP | 2012-102927 | A | 5/2012 |

OTHER PUBLICATIONS

Office Action dated Mar. 27, 2014, by the Chinese Patent Office in corresponding Chinese Patent Application No. 201210175713.2, and an English Translation of the Office Action. (19 pages).
Office Action dated Oct. 27, 2014, by the Chinese Patent Office in corresponding Chinese Patent Application No. 201210175713.2 and an English translation of the Office Action. (20 pages).
Extended European Search Report dated Oct. 6, 2017, by the European Patent Office in corresponding European Patent Application No. 12169458.2 (7 pages).

* cited by examiner

AIR-CONDITIONING APPARATUS INCLUDING A CONTROLLER THAT CONTROLS OPENING DEGREES OF EXPANSION VALVES BASED ON DETECTION RESULTS OF HUMAN DETECTION DEVICES

TECHNICAL FIELD

The present disclosure relates to an air-conditioning apparatus, in particular, an air-conditioning apparatus individually conditioning a plurality of spaces to be cooled.

BACKGROUND ART

As a method of reducing power consumption during use of an air-conditioning apparatus, methods such as, when the user is leaving a room, the user manipulating the remote control and stopping the operation or changing the temperature setting to reduce the air conditioning load can be considered. Other than this method, an air-conditioning apparatus that is provided with a human detection sensor detecting the presence or absence of people in the room has been proposed (see, for example, Patent Literature 1).

The technique described in Patent Literature 1 includes a plurality of air conditioning units in which when a human detection sensor detects absence of people, the temperature setting of the air conditioning unit corresponding to the absent room is automatically changed such that the air conditioning load is reduced.

CITATION LIST

Patent Literature

Patent Literature 1: Japanese Unexamined Patent Application Publication No. 11-132530 (see, for example, FIGS. 1 and 2)

SUMMARY OF INVENTION

Technical Problem

In the method in which the user himself/herself stops the operation or changes the temperature setting, there is a possibility of the user forgetting to manipulate or misoperating the switch, along with the problem that switching itself is bothersome. That is, the user usability is hampered by this method of reducing power consumption.

The method described in Patent Literature 1 reduces power consumption during use by automatically changing the temperature setting of the room in which the user is absent so as to reduce the air conditioning load. However, the technique described in Patent Literature 1 has not considered the distribution of refrigerant to each air conditioning unit according to the number of people in each room. Thus, depending on the number of people in the room, there is a possibility that the operation of the compressor is, in proportion to the number of the people, not highly efficient.

Further, since the technique described in Patent Literature 1 does not distribute the refrigerant according to the number of people in each room, there is a possibility that, even when the temperature settings of the rooms are the same, the degree of effectiveness of the conditioning differ, thus decreasing user comfortability.

That is to say, the technique described in Patent Literature 1 cannot achieve reduction of power consumption with high efficiency while improving user comfortability.

The present disclosure has been made to solve the above problem, and a primary object is to provide an air-conditioning apparatus achieving reduction of power consumption with high efficiency while improving user comfortability.

Solution to Problem

An air-conditioning apparatus according to the present disclosure includes a compressor, a heat source side heat exchanger, a plurality of expansion devices, and a plurality of use side heat exchangers being connected by refrigerant piping constituting a refrigeration cycle; human detection devices that detect the number of people in conditioned spaces supplied with conditioned air from the use side heat exchangers; and control means that controls an amount of refrigerant supplied to the use side heat exchangers by controlling opening degrees of the expansion devices on the basis of detection results of the human detection devices.

Advantageous Effects of Invention

The air-conditioning apparatus according to the present disclosure is capable of appropriately distributing refrigerant that is supplied to a plurality of use side heat exchangers according to the number of people in each room, and is capable of achieving reduction of power consumption with high efficiency while improving user comfortability.

DESCRIPTION OF EMBODIMENTS

Embodiment of the invention will be described below with reference to the drawings.

Embodiment 1

Figure 1:
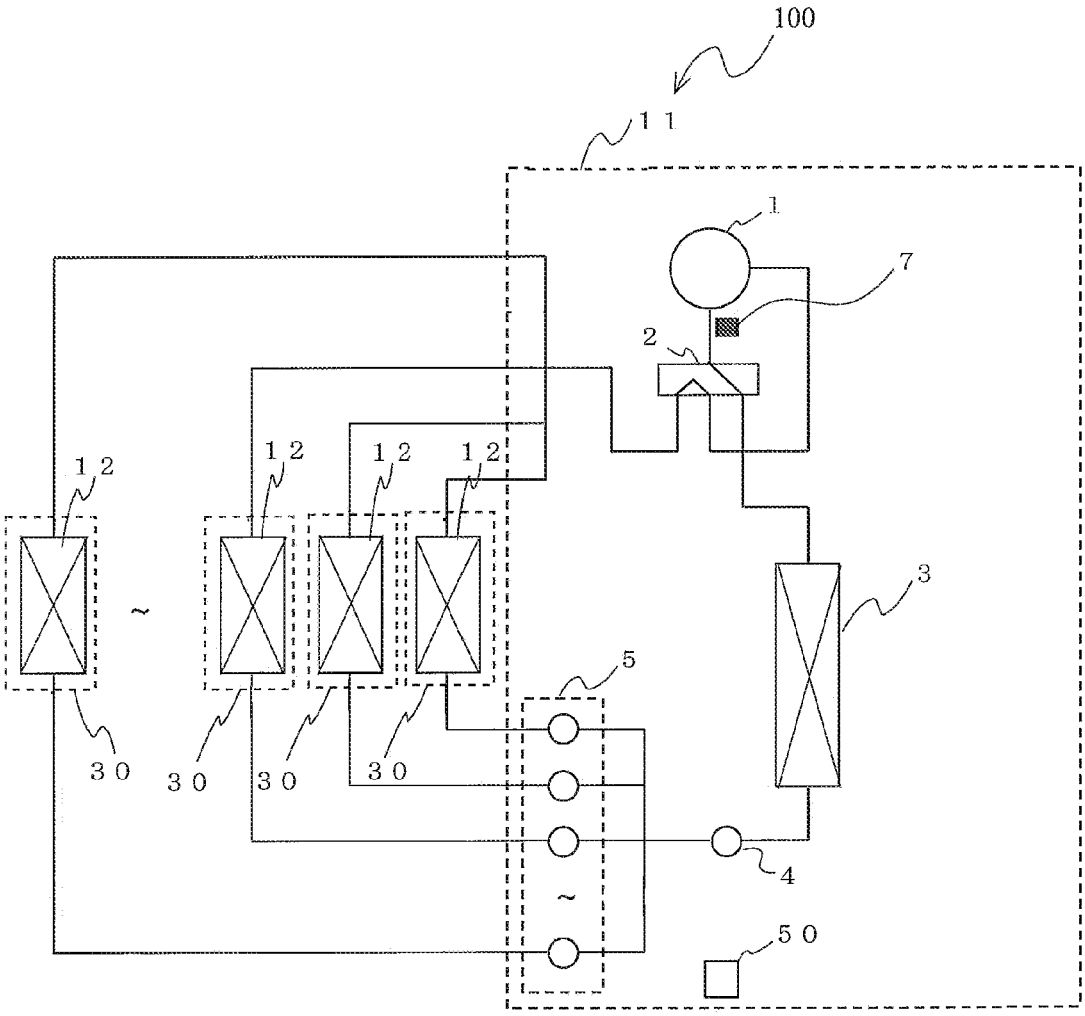
FIG. 1 is an exemplary diagram illustrating a refrigerant circuit configuration of an air-conditioning apparatus according to Embodiment 1 of the disclosure.
Figure 2:
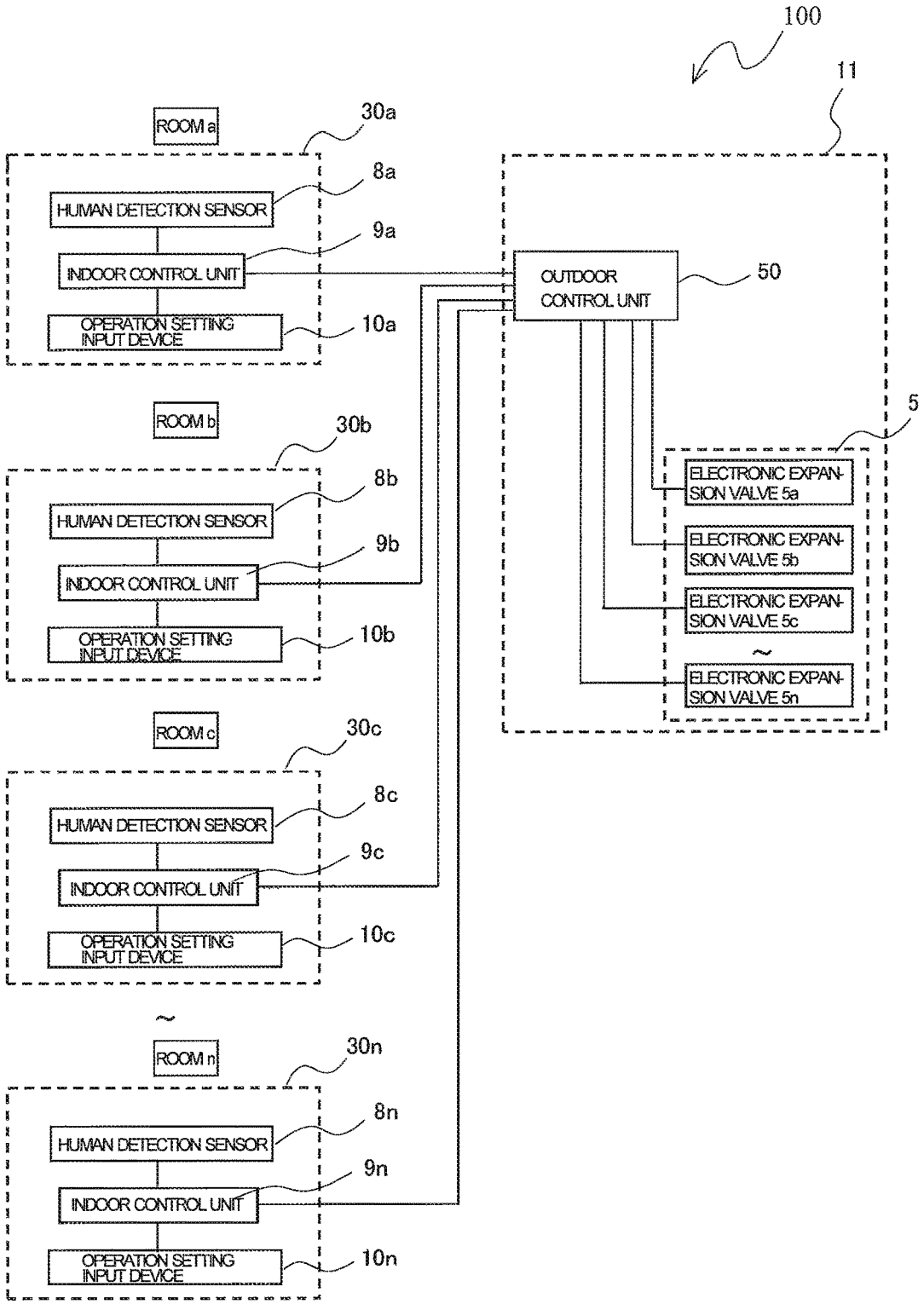
FIG. 2 is an exemplary diagram of a system configuration of the air-conditioning apparatus illustrated in FIG. 1.

FIG. 1 is an exemplary diagram illustrating a refrigerant circuit configuration of the air-conditioning apparatus 100 according to Embodiment 1 of the disclosure. FIG. 2 is an exemplary diagram of a system configuration of the air-conditioning apparatus 100 illustrated in FIG. 1.

The air-conditioning apparatus 100 is modified such that the distributed amount of refrigerant supplied to each indoor unit 30 is controlled according to the number of people in the conditioned space.

The air-conditioning apparatus 100 includes an outdoor unit 11 and a plurality of indoor unit 30, which are connected by refrigerant piping.

The outdoor unit 11 includes, as shown in FIG. 1, a compressor 1 compressing and conveying refrigerant, a four-way valve 2 switching passages, an outdoor heat exchanger 3 that functions as a condenser during cooling operation and functions as an evaporator during heating operation, a main electronic expansion valve 4 and a plurality of electric expansion valves for each room 5 decompressing the refrigerant, a temperature sensor 7 detecting a temperature of the refrigerant discharged from the compressor 1, and an outdoor control unit 50 controlling opening degrees of the electronic expansion valves for each room 5.

The indoor units 30 includes, as shown in FIG. 1, indoor heat exchangers 12 that function as evaporators during cooling operation and function as condensers during heating operation. Further, each indoor unit 30 includes, as shown in FIG. 2, a human detection sensor 8 that detects the existence/absence of people in the conditioned space, operation setting input means 10 that receives a setting from a user, and an indoor control unit 9 that is connected to the outdoor control unit 50.

Figure 4:
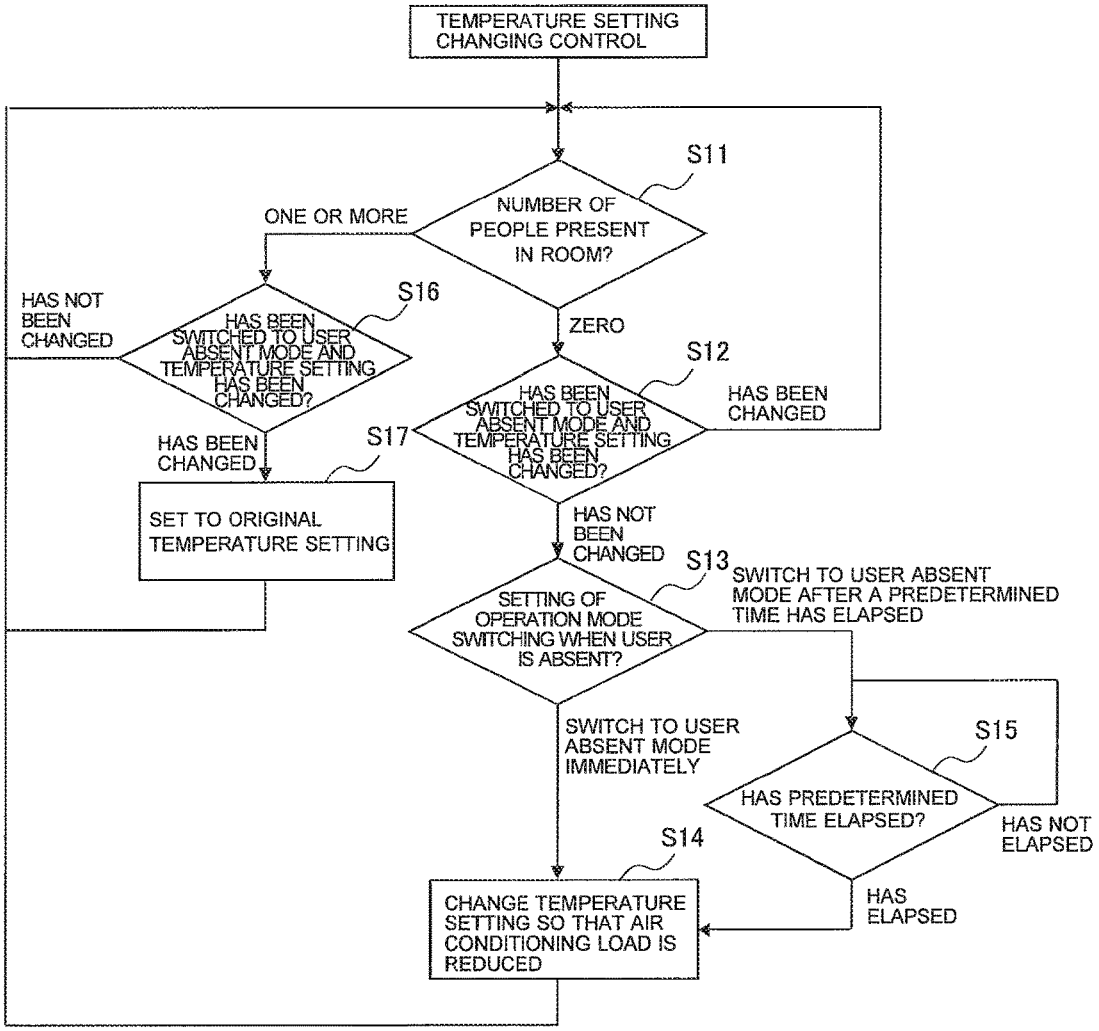
FIG. 4 is an exemplary flowchart illustrating a temperature setting changing control of the air-conditioning apparatus according to Embodiment 1.

Note that the conditioned space mentioned above corresponds to a room, a warehouse, and the like, but in Embodiment 1, it is assumed to be a room, and in FIG. 4, it is denoted as "room a" to "room n". Furthermore, corresponding to room a to room n, each human detection sensor 8, indoor control unit 9, and operation setting input means 10 are also attached with "a" to "n".

The compressor 1 sucks in the refrigerant, compresses the refrigerant into a high-temperature high-pressure state, and conveys the refrigerant to the refrigerant circuit. The discharge side of the compressor 1 is connected to the four-way valve 2, and the suction side thereof is connected to the outdoor heat exchanger 3 or the indoor heat exchangers 12. Note that a compressor in which its rotation speed is controlled by an inverter or the like may be preferably employed as the compressor 1.

The four-way valve 2 connects the discharge side of the compressor 1 to the indoor heat exchangers 12, as well as connecting the suction side of the compressor 1 to the outdoor heat exchanger 3 during heating operation and connects the discharge side of the compressor 1 to the outdoor heat exchanger 3, as well as connecting the suction side of the compressor 1 to the indoor heat exchangers 12 during cooling operation. Note that although in FIG. 1, an air-conditioning apparatus in which passages are switched by a four-way valve 2 is shown, not limited to this, a two-way valve or a three-way valve or the like configured in combination so as to be able to switch passages may be employed, for example.

The outdoor heat exchanger 3 functions as a condenser (radiator) during cooling operation and functions as an evaporator during heating operation. Further, the outdoor heat exchanger 3 exchanges heat with air that is taken into the outdoor unit 11 with a fan (not shown) and refrigerant, condenses and liquefies the refrigerant during cooling operation, and evaporates and gasifies the refrigerant during heating operation. One side of this outdoor heat exchanger 3 is connected to the electronic expansion valves for each room 5 and the other side is connected to the four-way valve 2. The outdoor heat exchanger 3 may include, for example, a plate fin and tube heat exchanger that is capable of exchanging heat between the refrigerant flowing in the refrigerant piping and the air passing through the fins.

The main electronic expansion valve 4 and the plurality of electronic expansion valves for each room 5 decompress and expand the refrigerant. One side of the main electronic expansion valve 4 is connected to the outdoor heat exchanger 3 and the other side is connected to the electronic expansion valves for each room 5. The opening degree of the main electronic expansion valve 4 is controlled so as to be proportionate to the circulating amount of the refrigerant. That is, when the circulating amount of the refrigerant increases, the opening degree is increased, and when the circulating amount decreases, the opening degree is decreased.

Each electronic expansion valve for each room 5 is connected to the corresponding indoor heat exchanger 12 on one side and is connected to the main electronic expansion valve 4 on the other side. Here, the number of the electronic expansion valves for each room 5 is configured so as to correspond to the number of indoor units 30. The electronic expansion valves for each room 5 are controlled so that the temperature of the gaseous refrigerant discharged from the compressor 1 or the temperature of the upper portion of the compressor 1 detected by the temperature sensor 7 is within a predetermined range.

Note that the configuration may be such that the main electronic expansion valve 4 is not provided by having the electronic expansion valves for each room 5 to include the function of the main electronic expansion valve 4. However, in the description of Embodiment 1, it is described such that the main electronic expansion valve 4 is provided.

The temperature sensor 7 detects the temperature of the refrigerant that is discharged from the compressor 1. The temperature sensor 7 is also connected to the outdoor control unit 50. This temperature sensor 7 is preferably constituted by a thermister or the like.

The outdoor control unit 50 controls at least the opening degree of the main electronic expansion valve 4 and the opening degrees of the electronic expansion valves for each room 5. Specifically, the outdoor control unit 50 is connected to the indoor control unit 9 and the temperature sensor 7, and on the basis of the output of these devices, controls the opening degree of the main electronic expansion valve 4 and the opening degrees of the electronic expansion valves for each room 5.

Each of the indoor heat exchangers 12 functions as an evaporator during cooling operation and functions as a condenser (radiator) during heating operation. Further, each of the indoor heat exchangers 12 exchanges heat with air that is taken into the corresponding indoor unit 30 with a fan (not shown) and refrigerant, evaporates and gasifies the refrigerant during cooling operation, and condenses and liquefies the refrigerant during heating operation. One side of each indoor heat exchanger 12 is connected to the corresponding electronic expansion valve for each room 5 and the other side is connected to the four-way valve 2. Each indoor heat exchanger 12 may include, for example, a plate fin and tube heat exchanger that is capable of exchanging heat between the refrigerant flowing in the refrigerant piping and the air passing through the fins.

The human detection sensor 8 detects the presence/absence of people in a room. The human detection sensor 8 is connected to the indoor control unit 9. Note that although the human detection sensor 8 is described as being provided in the indoor unit 30, it is not limited to the indoor unit 30 and may be disposed in the room or the like as long as it is connected to the indoor control unit 9. The human detection sensor 8 may desirably employ, for example, an infrared sensor.

The operation setting input means 10 sets how the switching is to be conducted when switching to user absent mode of step S13 in a temperature setting changing control described subsequently in FIG. 4. Note that the user absent mode is an operation mode reducing the air conditioning load by changing the temperature setting of the indoor unit 30 disposed in a room determined as the user being absent. That is, when switching to user absent mode, the operation setting input means 10 sets whether switching is to be performed after a predetermined time has elapsed or switching is to be performed immediately.

Further, when proceeding to step S23 of an operation stop/operation start control, which will be described in FIG. 5 subsequently, the operation setting input means 10 sets whether the indoor unit 30 in operation is to be stopped. That is, the user can set whether the indoor unit 30 will be stopped or not when the user is absent by presetting the operation setting input means Further, when proceeding to step S27 of the operation stop/operation start control, which will be described in FIG. 5 subsequently, the operation setting input means 10 sets whether the indoor unit 30 not in operation is to be started. That is, by presetting the operation setting input means 10, the user can set whether the indoor unit 30 will be started or not when the indoor unit 30 is suspended and the user is present.

The operation setting input means 10 is connected to the indoor control unit 9. Note that although the operation setting input means 10 is described as being provided in the indoor unit 30, it may be provided in a remote control and the like. In addition, the operation setting input means 10 may be configured with a button used to output ON/OFF to the indoor control unit 9.

The indoor control unit 9 outputs the detection results of the human detection sensor 8 and the operation setting input means 10 to the outdoor control unit 50. The indoor control unit 9 is connected to the human detection sensor 8, the operation setting input means 10, and the outdoor control unit 50. Note that, the indoor control unit 9 is a control unit separate from the outdoor control unit 50, as shown in FIG. 2, but may be an integrated control unit.

[Description of Operation (Flow of Refrigerant)]

First, description will be given on the operation during the cooling operation.

A high-temperature high-pressure gas refrigerant that has been discharged from the compressor 1 passes through the four-way valve 2, flows into the outdoor heat exchanger 3, and is condensed and liquefied into a high-temperature high-pressure liquid refrigerant. The refrigerant that has flowed out of the outdoor heat exchanger 3 flows into the main electronic expansion valve 4 and is branched after being expanded. Each of the branched refrigerant flows into the corresponding electronic expansion valve for each room 5, is decompressed into a low-pressure high-temperature, two-phase gas-liquid refrigerant. The refrigerant that has flowed out of each electronic expansion valve for each room 5 flows into the corresponding indoor heat exchanger 12, is evaporated and gasified into a low-pressure low-temperature gas refrigerant. The refrigerant that has flowed out of each indoor heat exchanger 12 is merged, and is sucked into the compressor 1 through the four-way valve 2.

Next, description will be given on the operation during the heating operation.

The high-temperature high-pressure gas refrigerant that has been discharged from the compressor 1 is branched after flowing out of the four-way valve 2. Further, each of the branched refrigerant flows into the corresponding indoor heat exchanger 12 and is condensed and liquefied into a high-temperature high-pressure liquid refrigerant. The refrigerant that has flowed out of the indoor heat exchanger 12 flows into the corresponding electronic expansion valve for each room 5 and is merged after being expanded. The merged refrigerant flows into the main electronic expansion valve 4, is decompressed into a low-pressure high-temperature, two-phase gas-liquid refrigerant. The refrigerant that has flowed out of the main electronic expansion valve 4 flows into the outdoor heat exchanger 3, is evaporated and gasified into a low-pressure low-temperature gas refrigerant. The refrigerant that has flowed out of the outdoor heat exchanger 3 is sucked into the compressor 1 through the four-way valve 2.

[Control of Opening Degree of Electronic Expansion Valve (Refrigerant Distribution Control)]

The indoor control unit 9 carries out control of the opening degree of the electronic expansion valve (hereinafter, referred to as refrigerant distribution control), temperature setting changing control, and shutdown/startup control. Note that the three controls may be processed parallelly or may be processed serially such that the process proceeds to the refrigerant distribution control after the temperature setting changing control is ended. Herein, before going into the specific details of the refrigerant distribution control, the temperature setting changing control, and the shutdown/startup control, overviews of these controls will be provided.

The air conditioning load that is required in a room with a large number of people is generally larger than the air conditioning load that is required in a room with a few people. The "refrigerant distribution control" is a control that controls the flow rate of the refrigerant by controlling the opening degree of each electronic expansion valve for each room 5 according to the number of people in each room. That is, the refrigerant distribution control is a control that controls the flow rate of the refrigerant according to the number of people in each room rather than changing the temperature setting according to the number of people in each room.

The "temperature setting changing control" is a control that changes the temperature setting of the room in which the user is absent. The temperature setting changing control can omit wasteful operations and reduce power consumption while suppressing user usability from being reduced.

The "shutdown/startup control" is a control that stops the operation of the indoor unit 30 corresponding to the room with the user being continuously absent for a predetermined time and a control that starts the operation of a suspended indoor unit 30 triggered by the presence of a user in the absent room. The shutdown/startup control can omit wasteful operations and reduce power consumption while suppressing user usability from being reduced.

Figure 3:
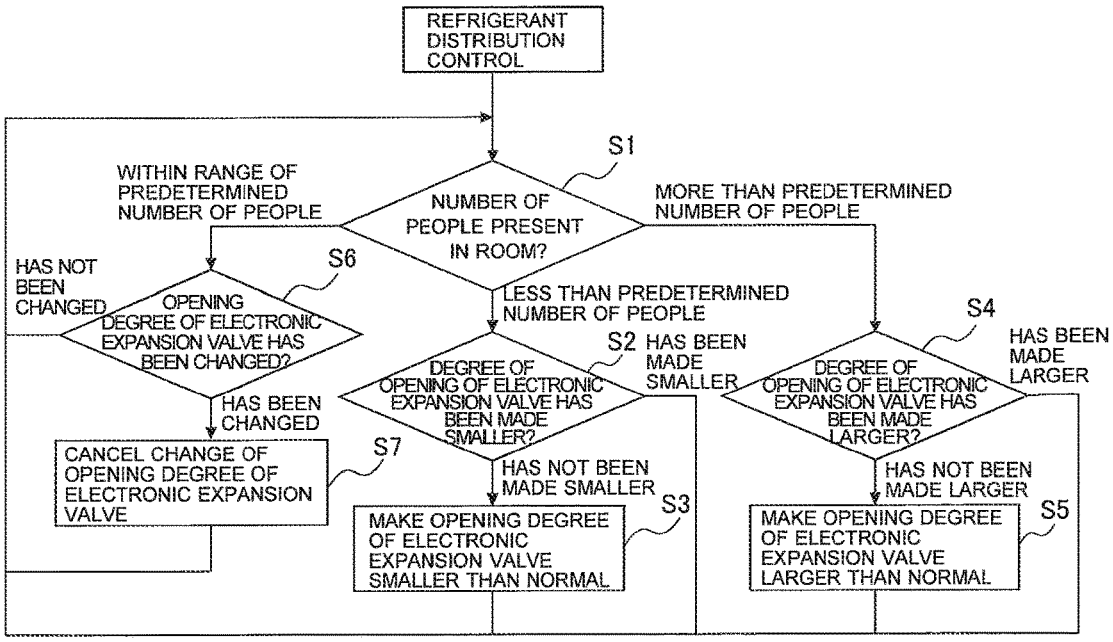
FIG. 3 is an exemplary flowchart illustrating a refrigerant distribution control of the air-conditioning apparatus according to Embodiment 1.

First, the "refrigerant distribution control" will be described with reference to FIG. 3. FIG. 3 is an exemplary flowchart illustrating the refrigerant distribution control of the air-conditioning apparatus 100. Note that in the subsequent description, the indoor control units 9 and the outdoor control unit 50 is integrated. This integrated control unit will be referred to as control means.

(Step S1)

The control means determines the number of people stayed in each room on the basis of the detection results of the corresponding human detection sensor 8.

When the number of stayed people is determined as being less than a first predetermined value, the control means proceeds to step S2.

When the number of stayed people is determined as being equal to or more than a second predetermined value, the control means proceeds to step S4.

When the number of stayed people is determined as being equal to or more than the first predetermined value and less than the second predetermined value, the control means proceeds to step S6.

(Step S2)

The control means determines whether the opening degree of the electronic expansion valve for each room 5 corresponding to the room that has been determined as having less number of people in the room than the first predetermined value is changed to a smaller degree than normal.

The control means returns to step S1 when it is determined that the opening degree of the electronic expansion valve for each room 5 has been changed to a smaller degree.

The control means proceeds to step S3 when it is determined that the opening degree of the electronic expansion valve for each room 5 has not been changed to a smaller degree.

Note that the aforementioned "normal" is used as meaning the normal used in "normal operation" when normal operation is defined as an operation in which the opening degree of the electronic expansion valve for each room 5 is controlled on the basis of the temperature setting alone without control of the opening degree of the electronic expansion valve for each room 5 on the basis of the number of people in the room. Furthermore, the "normal" mentioned subsequently has the same meaning.

(Step S3)

The control means changes the opening degree of the electronic expansion valve for each room 5 corresponding to the room that has been determined as having less number of people in the room than the first predetermined value to a smaller degree than normal. The control means subsequently proceeds to step S1.

(Step S4)

The control means determines whether the opening degree of the electronic expansion valve for each room 5 corresponding to the room that has been determined as having equal or more number of people in the room than the second predetermined value has been changed to a larger degree than normal.

The control means returns to step S1 when it is determined that the opening degree of the electronic expansion valve for each room 5 has been changed to a larger degree.

The control means proceeds to step S5 when it is determined that the opening degree of the electronic expansion valve for each room 5 has not been changed to a larger degree.

(Step S5)

The control means changes the opening degree of the electronic expansion valve for each room 5 corresponding to the room that has been determined as having equal or more number of people in the room than the second predetermined value to a larger degree than normal. The control means subsequently proceeds to step S1.

(Step S6)

The control means determines whether the opening degree of the electronic expansion valve for each room 5 corresponding to the room that has been determined as having equal or more number of people in the room than the first predetermined value and having less number of people than the second predetermined value has been changed against the opening degree of the electronic expansion valve for each room 5 during normal operation.

The control means proceeds to step S7 when it is determined that the opening degree of the electronic expansion valve for each room 5 has been changed.

The control means returns to step S1 when it is determined that the opening degree of the electronic expansion valve for each room 5 has not been changed.

(Step S7)

The control means changes the opening degree of the electronic expansion valve for each room 5 corresponding to the room that has been determined as having equal or more number of people in the room than the first predetermined value and having less number of people than the second predetermined value back to the opening degree of the electronic expansion valve for each room 5 during normal operation. The control means subsequently proceeds to step S1.

FIG. 4 is an exemplary flowchart illustrating the temperature setting changing control of the air-conditioning apparatus 100. First, the "temperature setting changing control" will be described with reference to FIG.

(Step S11)

The control means determines the number of stayed people on the basis of the detection results of the human detection sensor 8.

When the number of people in the room is determined as being one or more, the control means proceeds to step S16.

When the number of people in the room is determined as being zero, the control means proceeds to step S12.

(Step S12)

The control means determines whether the operation has been switched to the user absent mode.

When the operation is determined as being the user absent mode, the control means returns to step S12.

When the operation is not determined as being the user absent mode, the control means proceeds to step S13.

(Step S13)

The control means determines the setting of the operation setting input means 10.

When the setting is determined to be set so as to switch to user absent mode after a predetermined time has elapsed, the control means proceeds to step 15.

When the setting is determined to be set so as to switch to user absent mode immediately, the control means proceeds to step 14.

(Step S14)

The control means carries out the user absent mode. The control means subsequently returns to step S11.

Note that carrying out the user absent mode corresponds to increasing the temperature setting during cooling and reducing the temperature setting during heating.

(Step S15)

The control means determines whether a predetermined time has elapsed.

When it is determined that a predetermined time has elapsed, the control means proceeds to step S14.

When it is determined that a predetermined time has not elapsed, the control means returns to step S15.

(Step S16)

The control means determines whether the operation has been switched to the user absent mode.

When the operation is determined as being the user absent mode, the control means proceeds to step S17.

When the operation is not determined as being the user absent mode, the control means returns to step S11.

(Step S17)

The control means cancels the user absent mode and returns to normal operation. The control means subsequently returns to step S11.

Figure 5:
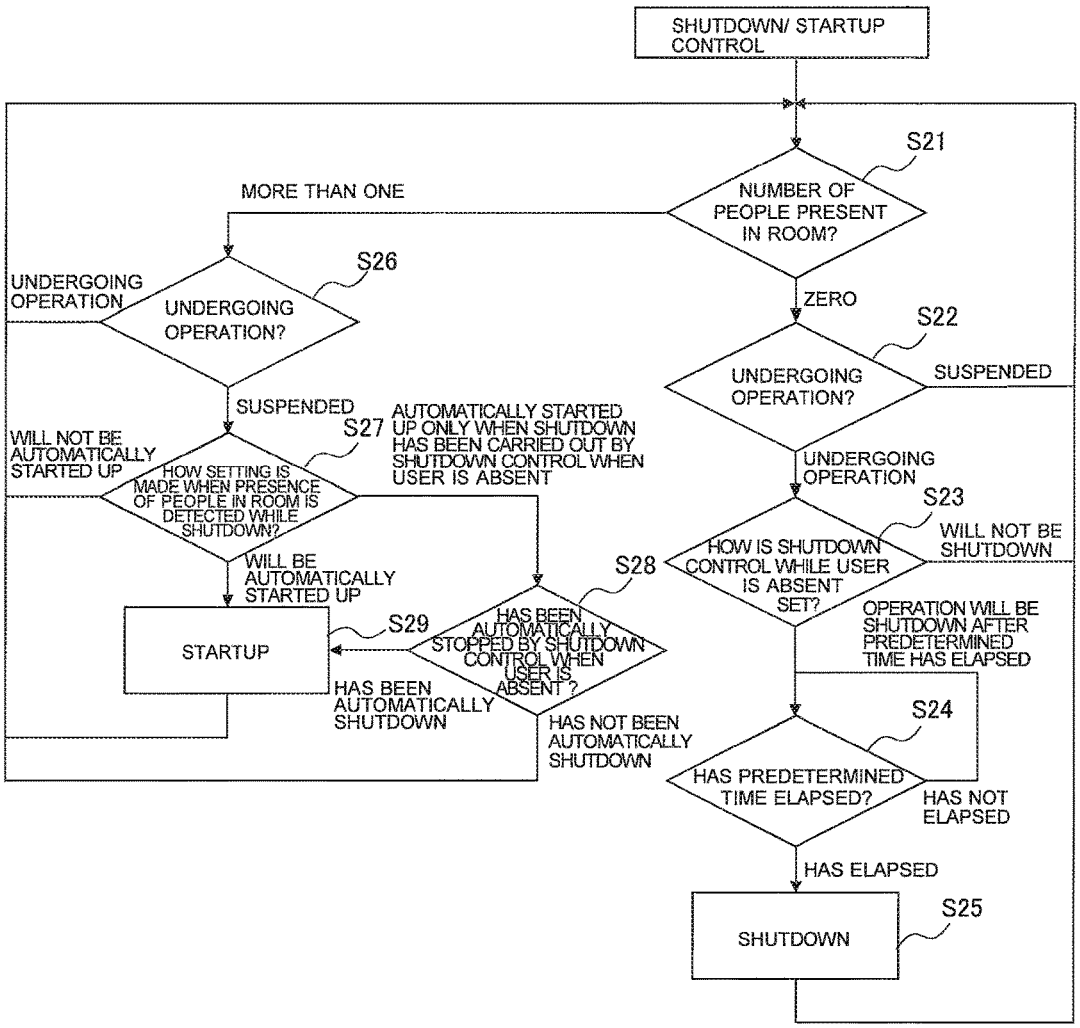
FIG. 5 is an exemplary flowchart illustrating a shutdown/startup control of the air-conditioning apparatus according to Embodiment 1.

FIG. 5 is an exemplary flowchart illustrating the shutdown/startup control of the air-conditioning apparatus 100. Next, the "shutdown/startup control" will be described with reference to FIG. 5.

(Step S21)

The control means determines the number of stayed people on the basis of the detection results of the human detection sensor 8.

When the number of people in the room is determined as being one or more, the control means proceeds to step S26.

When the number of people in the room is determined as being zero, the control means proceeds to step S22.

(Step S22)

The control means determines whether the indoor unit 30 that has been determined to have zero number of people in the room is in operation.

When the indoor unit 30 that has been determined to have zero number of people in the room is in operation, the control means proceeds to step S23.

When the indoor unit 30 that has been determined to have zero number of people in the room is not in operation, the control means returns to step S21

(Step S23)

The control means determines the setting of the operation setting input means 10.

When the indoor unit 30 that has been determined to have zero number of people in the room is set to stop, the control means proceeds to step S24.

When the indoor unit 30 that has been determined to have zero number of people in the room is not set to stop, the control means returns to step S21.

(Step S24)

The control means determines whether a predetermined time has elapsed.

When it is determined that a predetermined time has elapsed, the control means proceeds to step S25.

When it is determined that a predetermined time has not elapsed, the control means returns to step S24.

(Step S25)

The control means stops the indoor unit 30 that has been determined to have zero number of people in the room. The control means subsequently proceeds to step S21.

(Step S26)

The control means determines whether the indoor unit 30 that has been determined to have one or more people in the room is in operation.

When the indoor unit 30 that has been determined to have one or more people in the room is in operation, the control means returns to step S21.

When the indoor unit 30 that has been determined to have one or more people in the room is not in operation, that is, when it is determined to be suspended, the control means proceeds to step S27.

(Step S27)

The control means determines the setting of the operation setting input means 10 and whether operation has been stopped in step S25.

During the suspension of the indoor unit 30 having one or more people in the room, when a presence of a person is detected in the room corresponding to the indoor unit 30 and when a setting has been made such that the operation is to be automatically started by the operation setting input means 10, then the control means proceeds to step S28.

During the suspension of the indoor unit 30 having one or more people in the room, when a presence of a person is detected in the room corresponding to the indoor unit 30 and when a setting has been made such that the operation is not to be automatically started by the operation setting input means 10, then the control means proceeds to step S21.

When the process has proceeded from step S21 to step S22 before, irrespective of the setting of the operation setting input means 10, the control means proceeds to step S28.

(Step S28)

The control means determines whether the suspended indoor unit 30 having one or more people in the room has stopped in step S25.

When it is determined that the indoor unit 30 has stopped after proceeding to step S25, the control means proceeds to step S29.

When it is determined that the indoor unit 30 has not stopped after proceeding to step S25, the control means proceeds to step S21.

(Step S29)

The control means starts the indoor unit 30 that has been determined to have one or more people in the room. The control means subsequently proceeds to step S21.

[Advantageous Effects of Air-Conditioning Apparatus 100]

The air-conditioning apparatus 100 controls the flow rate of the refrigerant with the refrigerant distribution control that controls the opening degree of the electronic expansion valve for each room 5 according to the number of people in each room.

The air conditioning load that is required in a room with a large number of people is larger than the air conditioning load that is required in a room with a few people. Accordingly, the air-conditioning apparatus 100 does not change the temperature setting, but carries out refrigerant distribution control that controls the flow rate of the refrigerant by controlling the opening degree of the electronic expansion valve for each room 5 according to the number of people in each room. Therefore, the air-conditioning apparatus 100 is capable of reducing power consumption of the compressor 1 with high efficiency while improving user comfortability.

That is, the air-conditioning apparatus 100 satisfies the air conditioning load by reducing the amount of refrigerant supplied to the indoor unit 30 that corresponds to the room with a small number of people in the room, and by supplying the reduced refrigerant to the indoor unit 30 that corresponds to the room with a large number of people in the room.

Furthermore, in addition to the refrigerant distribution control, the air-conditioning apparatus 100 is capable of automatically changing the temperature setting of the room in which the user is absent by the temperature setting changing control. With the above, wasteful operations can be omitted and power consumption can be reduced while suppressing user usability from being reduced.

Furthermore, in addition to the refrigerant distribution control, the "shutdown/startup control" is carried out by the air-conditioning apparatus 100, which is a control that stops the operation of the indoor unit 30 corresponding to the room with the user being continuously absent for a predetermined time and a control that starts the operation of a suspended indoor unit 30 triggered by the presence of a user in the absent room. With the above, wasteful operations can be omitted and power consumption can be reduced while suppressing user usability from being reduced.

Embodiment 2

Figure 6:
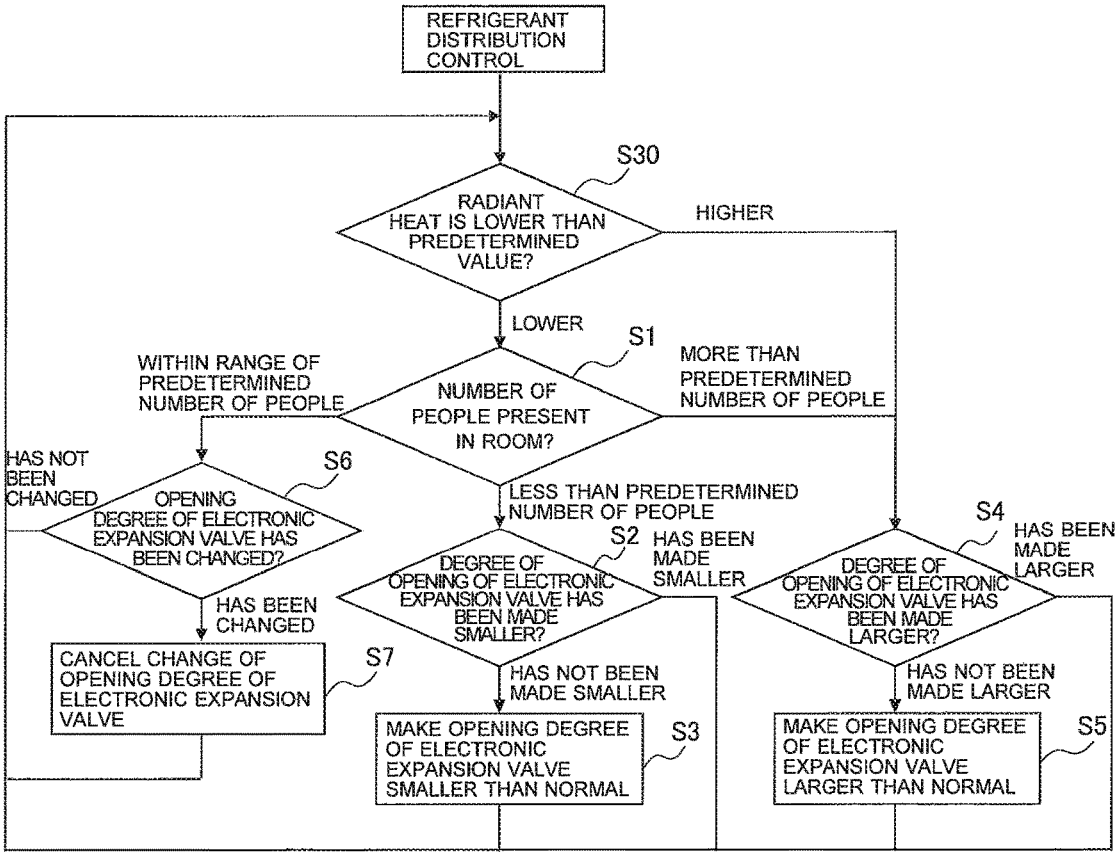
FIG. 6 is an exemplary flowchart illustrating a refrigerant distribution control of an air-conditioning apparatus according to Embodiment 2.
Figure 7:
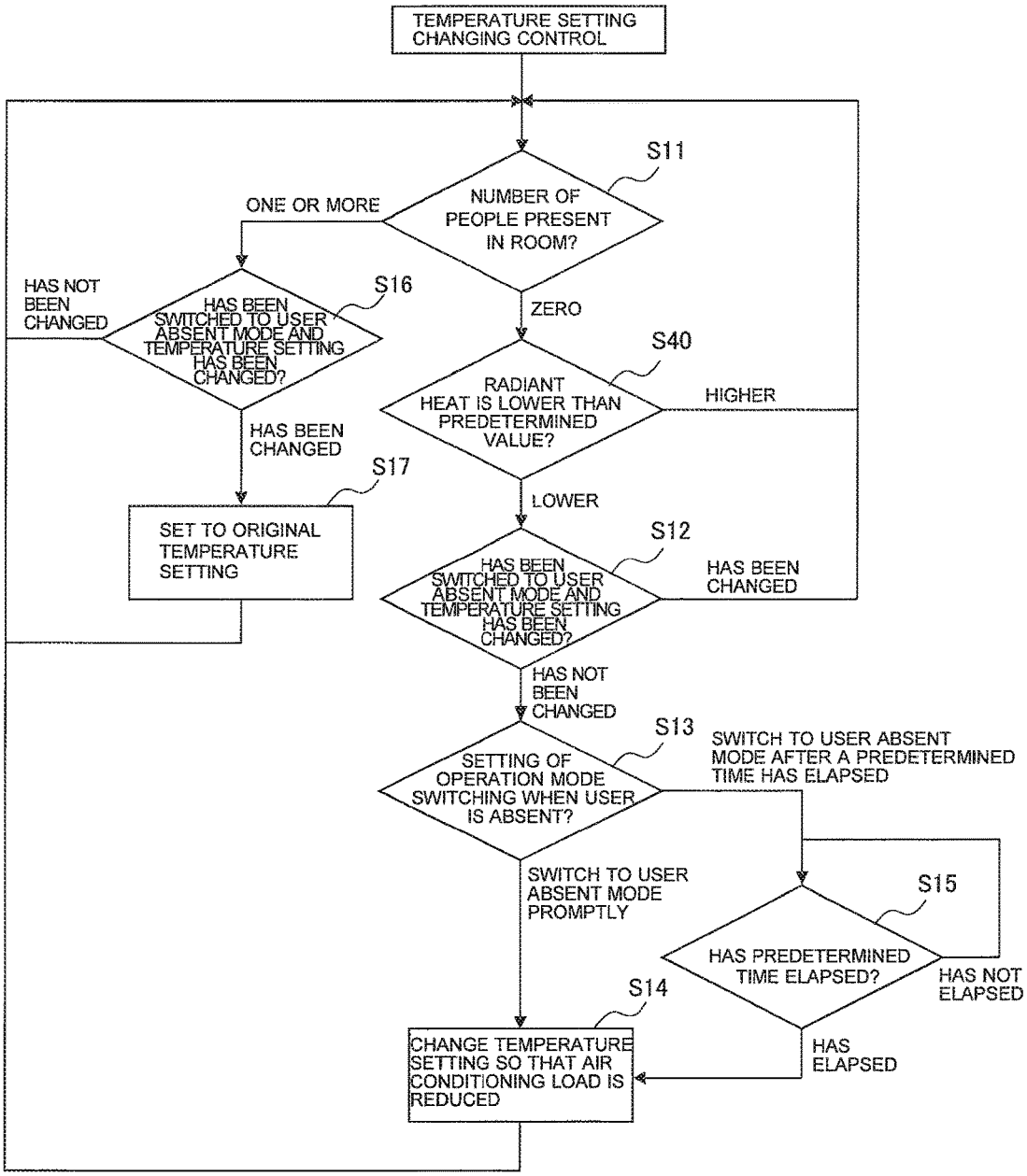
FIG. 7 is an exemplary flowchart illustrating a temperature setting changing control of the air-conditioning apparatus according to Embodiment 2.
Figure 8:
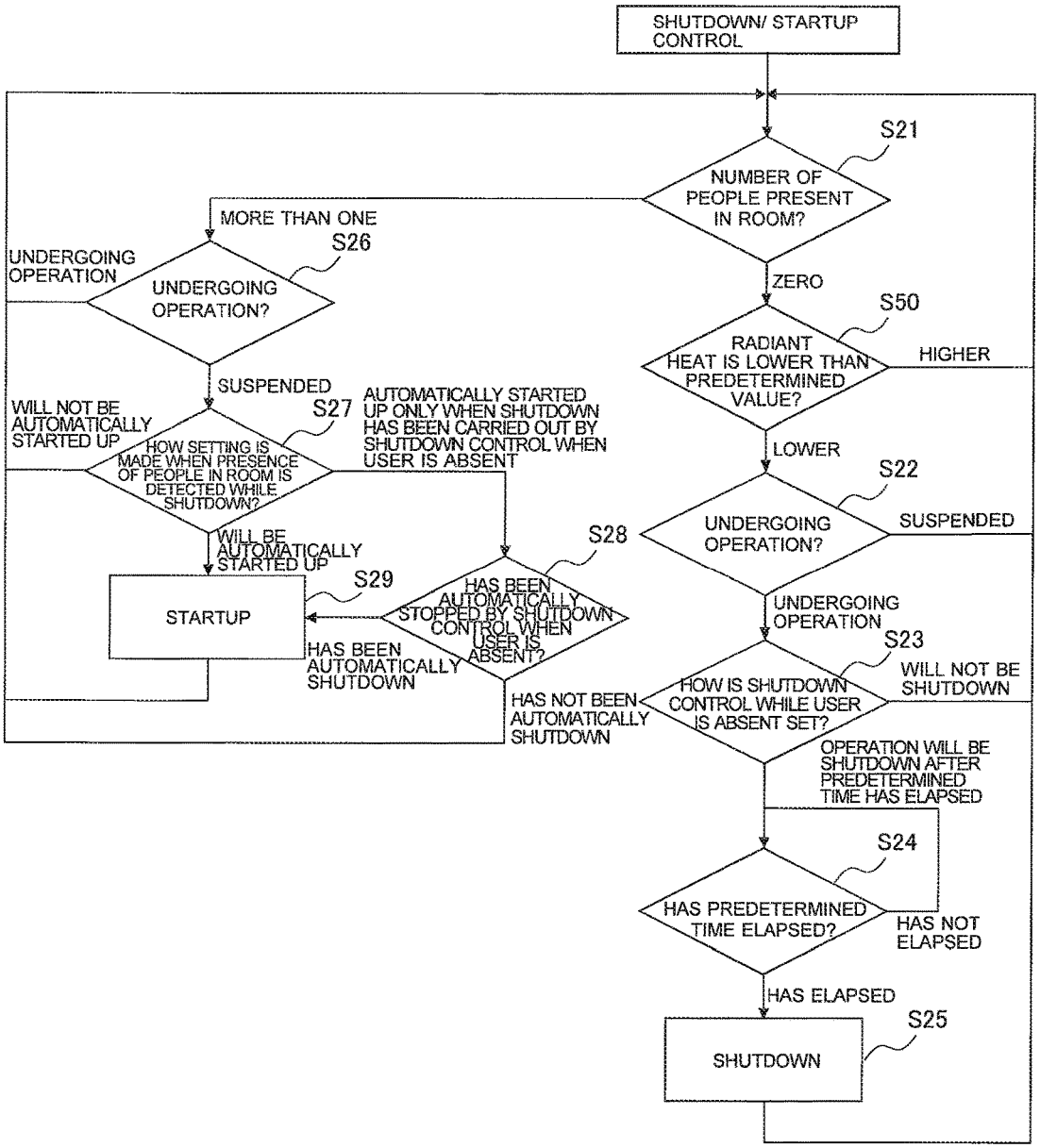
FIG. 8 is an exemplary flowchart illustrating a shutdown/startup control of the air-conditioning apparatus according to Embodiment 2.

FIG. 6 is an exemplary flowchart illustrating a refrigerant distribution control of an air-conditioning apparatus 100 according to Embodiment 2. FIG. 7 is an exemplary flowchart illustrating a temperature setting changing control of the air-conditioning apparatus 100 according to Embodiment 2. FIG. 8 is an exemplary flowchart illustrating a shutdown/startup control of the air-conditioning 100 apparatus according to Embodiment 2. In Embodiment 2, same parts as Embodiment 1 will be referred to with the same reference numerals, and portions different to that of Embodiment 1 will be described.

A human detection sensor 8 according to Embodiment 2 has a function of detecting radiant heat of a floor and walls of a room as well as detecting the presence/absence of people in the room. Further, a control means controls an opening degree of a main electronic expansion valve 4 and an opening degree of an electronic expansion valve for each room 5 on the basis of the number of people in the room and the radiant heat.

Here, although description of the human detection sensor 8 detecting the radiant heat along with the presence/absence of people in the room has been made, a sensor for detecting the radiant heat may be provided separately.

Here, FIG. 6 corresponds to FIG. 3, FIG. 7 corresponds to FIG. 4, and FIG. 8 corresponds to FIG. 5. Further, in FIG. 6, step S30 is inserted before step S1 of FIG. 3; in FIG. 7, step S40 is inserted between step S11 and step S12 of FIG. 4; and in FIG. 8, step S50 is inserted between step S21 and step S22 of FIG. 5. Step S30, step S40, and step S50 are as follows.

(Step S30)

The control means determines whether the radiant heat is lower than a predetermined value.

When the radiant heat is determined as being lower than the predetermined value, the control means proceeds to step S1.

When the radiant heat is not determined as being lower than the predetermined value, the control means proceeds to step S4.

(Step S40)

The control means determines whether the radiant heat is lower than a predetermined value.

When the radiant heat is determined as being lower than the predetermined value, the control means proceeds to step S12.

When the radiant heat is not determined as being lower than the predetermined value, the control means proceeds to step S11.

(Step S50)

The control means determines whether the radiant heat is lower than a predetermined value.

When the radiant heat is determined as being lower than the predetermined value, the control means proceeds to step S22.

When the radiant heat is not determined as being lower than the predetermined value, the control means proceeds to step S21.

Advantageous Effects of Air-Conditioning Apparatus 100 According to Embodiment 2

The air-conditioning apparatus 100 according to Embodiment 2 controls the electronic expansion valve for each room 5 on the basis of both the number of people in the room and the radiant heat. Accordingly, for example, when the air conditioning load is large such as when there is no one in the room but radiant heat is high or the radiant heat is low, each electronic expansion valve 5 for each room can be controlled so as to increase the heating or cooling capacity. On the other hand, for example, because of the small amount of radiant heat, when the air conditioning load is small even when there are a large number of people in the room, an operation suppressing energy consumption can be carried out.

In addition to the advantageous effect of the air-conditioning apparatus according to Embodiment 1, the air-conditioning apparatus 100 according to Embodiment 2 takes into consideration the radiant heat, and, thus is capable of improving the user comfortability by approaching the room temperature quickly to the temperature setting when there is a person in the room that had been absent, and is capable of suppressing energy consumption.

REFERENCE SIGNS LIST

1. compressor; 2. four-way valve; 3. outdoor heat exchanger; 4. main electronic expansion valve; 5. electronic expansion valve for each room; 7. temperature sensor; 8. human detection sensor; 9. indoor control unit; 10. operation setting input means; 11. outdoor unit; 12. indoor heat exchanger; 30. indoor unit; 50. outdoor control unit; 100 air-conditioning apparatus.

The invention claimed is:

1. An air-conditioning apparatus, comprising;

a refrigerant circuit including a compressor, a heat source side heat exchanger, a plurality of expansion valves, and a plurality of use side heat exchangers, each of the expansion valves being connected to a refrigerant path between the heat source side heat exchanger and corresponding one use side heat exchanger of the plurality of use side heat exchangers;

a plurality of infrared sensors located in a plurality of spaces to be monitored and conditioned, each infrared sensor configured to detect the number of people in the conditioned space it is located within in which air is heat-exchanged by the corresponding one use side heat exchanger; and a controller configured to set the opening degree for each of the expansion valves to a first opening degree on the basis of a setting temperature of the conditioned space, and change the opening degree for each of the expansion valves from the first opening degree to a second opening degree on the basis of the number of people detected by the infrared sensor for the conditioned space, wherein the controller is configured to, when comparing each detection result of the infrared sensors with a first predetermined number value of humans and determining that there is a conditioned space among the plurality of conditioned spaces in which the number of present people of the detection result is less than the first predetermined number value of humans, decrease the opening degree of the expansion valves connected to the use side heat exchanger corresponding to the conditioned space, and when comparing each detection result of the infrared sensors with a second predetermined number value of humans that is larger than the first predetermined number value of humans and determining that there is a conditioned space among the plurality of conditioned spaces in which the number of present people of the detection result is equal to or more than the second predetermined number value of humans, increase the opening degree of the expansion valve that is connected to the use side heat exchanger corresponding to the conditioned space.

2. The air-conditioning apparatus of claim 1, wherein after determining that the number of present people of the detection result is less than the first predetermined number value of humans and decreasing the opening degree of the corresponding expansion valve, the controller is configured to, when the number of present people of the detection result is equal to or more than the first predetermined number value of humans and is less than the second predetermined number value of humans, change the opening degree to the opening degree before the decrease.

3. The air-conditioning apparatus of claim 1, wherein after determining that the number of present people of the detection result is more than the second predetermined number value of humans and increasing the opening degree of the corresponding expansion valve, the controller is configured to, when the number of present people of the detection result is equal to or more than the first predetermined number value of humans and is less than the second predetermined value, change the opening degree to the opening degree before the increase.

4. The air-conditioning apparatus of claim 1, wherein when determining that there is a conditioned space among the plurality of conditioned spaces with zero people present by detection results of the infrared sensors, the controller is configured to, control an amount of refrigerant supplied to the corresponding use side heat exchanger by controlling the opening degree of the corresponding expansion valve on the basis of the detection results of the infrared sensors and further changes a temperature setting of the conditioned space so as to reduce the air conditioning load of the conditioned space.

5. The air-conditioning apparatus of claim 4, wherein after determining that there is the conditioned space among the plurality of conditioned spaces with zero people present and controlling the opening degree of the corresponding expansion valve, the controller is configured to, when there is a conditioned space with one or more present people on the basis of the detection results of the infrared sensors, change the temperature setting of the conditioned space to the temperature setting before the control.

6. The air-conditioning apparatus of claim 1, further comprising radiant heat detection devices that measure radiant heat of the conditioned spaces and output the measurement results to the controller, wherein the controller is configured to control the opening degrees of the expansion valves on the basis of measurement results of the radiant heat detection devices in addition to detection results of the infrared sensors.

* * * * *